US005485906A

United States Patent [19]

Newton et al.

[11] Patent Number: 5,485,906

[45] Date of Patent: Jan. 23, 1996

[54] COIN VALIDATORS

[75] Inventors: Michael E. Newton, Surby, Isle of Man; Michael D. Nunn, North Ascot, United Kingdom

[73] Assignee: Mars Incorporated, McLean, Va.

[21] Appl. No.: 70,422

[22] PCT Filed: Dec. 4, 1991

[86] PCT No.: PCT/GB91/02149

§ 371 Date: Jun. 4, 1993

§ 102(e) Date: Jun. 4, 1993

[87] PCT Pub. No.: WO92/10814

PCT Pub. Date: Jun. 25, 1992

[30] Foreign Application Priority Data

Dec. 7, 1990 [GB] United Kingdom ..... 9026676

[51] Int. Cl.[6] ..... G07D 5/00

[52] U.S. Cl. ..... 194/203; 194/346

[58] Field of Search ..... 194/203, 346; 453/4

[56] References Cited

U.S. PATENT DOCUMENTS

| | | | |
|---|---|---|---|
| 3,279,574 | 10/1966 | Seiden . | |
| 4,298,116 | 11/1981 | Niemeyer | 194/203 |
| 4,625,851 | 12/1986 | Johnson et al. | 194/346 X |
| 4,881,630 | 11/1989 | Kobayashi et al. | 194/203 |
| 4,918,724 | 4/1990 | Vogl et al. | 194/203 X |
| 5,145,046 | 9/1992 | Satoh | 194/203 |

FOREIGN PATENT DOCUMENTS

| | | |
|---|---|---|
| 0070353 | 1/1983 | European Pat. Off. . |
| 2628682 | 12/1977 | Germany . |
| 2224150 | 4/1990 | United Kingdom . |

*Primary Examiner*—F. J. Bartuska
*Attorney, Agent, or Firm*—Fish & Richardson

[57] ABSTRACT

A coin validator has a sensing arrangement disposed after an accept gate for detecting when a valid coin has moved past, and thus causing the triggering of the accumulation of credit. The sensing arrangement comprises a flap which is moved away from its normal position by the coin. If the coin is suspended on a string, the flap cannot move back to its normal position and therefore no credit is accumulated.

18 Claims, 4 Drawing Sheets

COIN VALIDATORS

FIELD OF THE INVENTION

BACKGROUND OF THE INVENTION

This invention relates to coin validators.

A well-known method of fraud associated with coin-operated machines involves attaching string or thread to a genuine coin and then inserting the coin into the machine while holding the string. Once the coin has passed the validating section and caused an appropriate amount of credit to be accumulated, the user is able to stop the coin from passing into a storage section by use of the string. He can then operate the machine to obtain goods or services, and then retrieve the coin, for example by pressing an escrow return button.

Although there are a number of known techniques for avoiding this coin-on-a-string fraud, it would be desirable to provide a solution which is very inexpensive to implement.

SUMMARY OF THE INVENTION

According to the present invention there is provided a coin validator having a sensing arrangement which is arranged to detect the passage of a coin which has left a testing section so as to trigger the accumulation of credit, characterised in that the sensing arrangement comprises a flap which is moved away from a first position by a coin leaving the testing section, and which will be held away from the first position by a thread attached to the coin and held by a user, thereby to inhibit the triggering of accumulation of credit.

It is known in validators to trigger the accumulation of credit only after the coin has moved past a sensor. By the simple provision of the flap, this sensing arrangement can be able to detect the passage of the coin by sensing when the flap returns to its first position. If it is prevented from returning by a thread attached to the coin, no credit is accumulated. It is therefore possible to avoid coin-on-a-string fraud by the simple addition of a flap to a known form of sensing arrangement.

BRIEF DESCRIPTION OF THE DRAWINGS

Arrangements embodying the invention will now be described by way of example with reference to the accompanying drawings, in which.

DETAILED DESCRIPTION OF THE INVENTION

Figure 1:
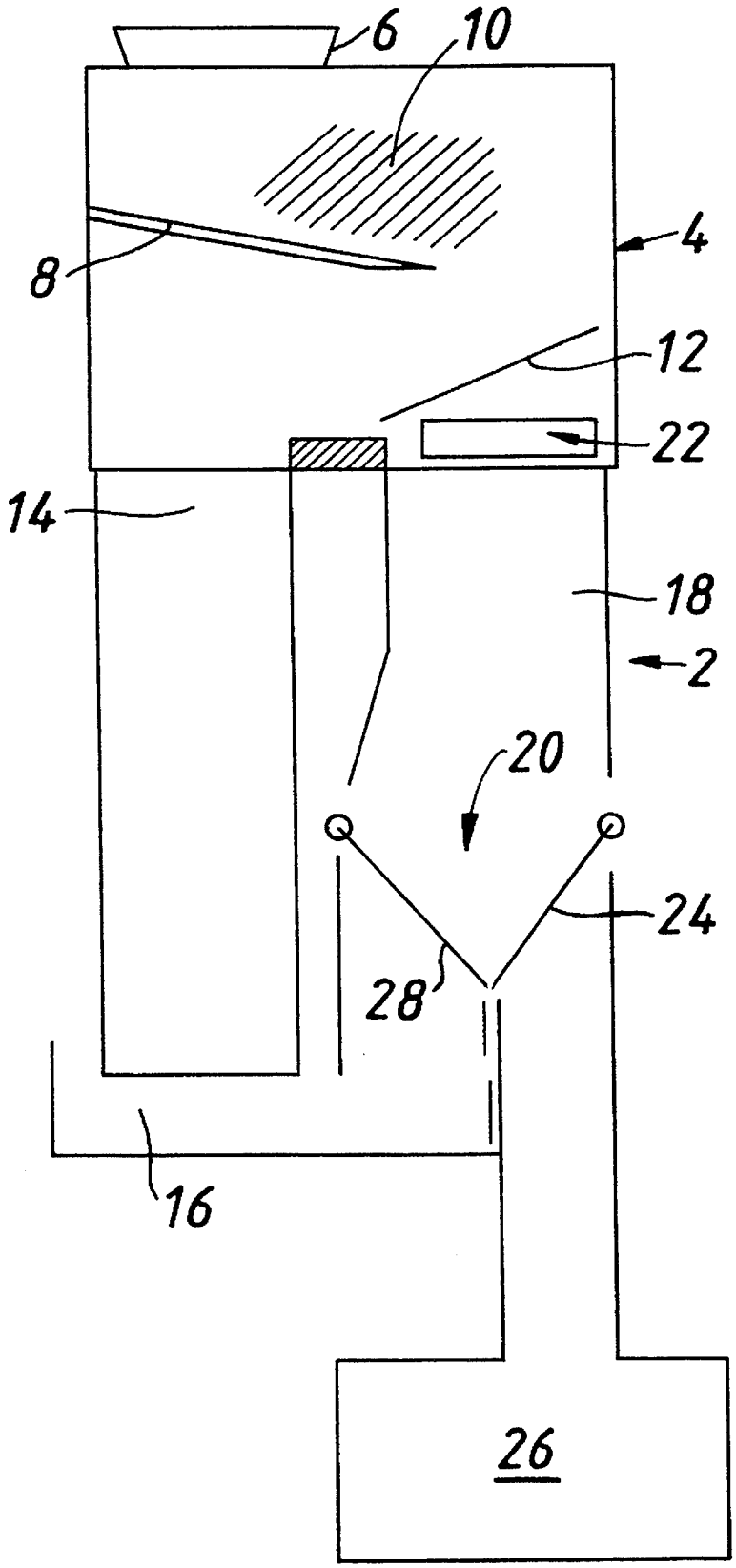
FIG. 1 is a schematic view of a coin mechanism including a validator according to the present invention.

Referring to FIG. 1, a coin mechanism 2 has a validator 4 which comprises a hopper 6 into which coins can be inserted. The coins fall on to a ramp 8 and then roll down the ramp past a testing region indicated by the shaded section 10. The coins then fall towards an accept gate shown schematically at 12. If the coins have been tested and found not to be genuine, the coins are diverted by the accept gate 12 into a reject path 14, which delivers the coins to a refund tray 16.

If the coins are acceptable, a solenoid is energised to cause the accept gate 12 to shift into a position in which it opens an accept path 18 leading to an escrow bucket 20. Coins entering the accept path 18 move past a sensing arrangement shown generally at 22. After the sensing arrangement 22 has detected that a coin has moved past, it triggers the accumulation of credit, thus permitting a user to operate a machine (not shown) in which the validator is housed. After the machine has provided goods or a service to the value of the accumulated credit, an escrow accept gate 24 is opened to allow a coin or coins held thereby to fall into a cash box 26. Before provision of the goods or services, the user can alternatively press an escrow return button (not shown) to cause an escrow return gate 28 to open and so allow coins in the escrow bucket 20 to travel to the refund tray 16.

Arrangements generally of this type are well known, although the physical structure of such arrangements varies substantially.

If the user attaches thread or cotton to the coin, he can prevent the coin from being delivered to the cash box 26 by holding the thread. Therefore, by operating the escrow return button after the services or goods have been provided, he can cause the coin to be delivered to the refund tray 16. In some arrangements, the user may be able to withdraw the coin past the sensing arrangement 22 and accept gate 12, and then up the ramp 8 so as to pull the coin out of the mouth of the hopper 6.

Such methods of fraud involve first allowing the coin to move past the sensing arrangement 22 so as to cause triggering of credit. The present invention relates to a method of avoiding fraud by preventing the sensing arrangement from detecting that the coin has moved past when the coin is held by thread.

Figure 2:
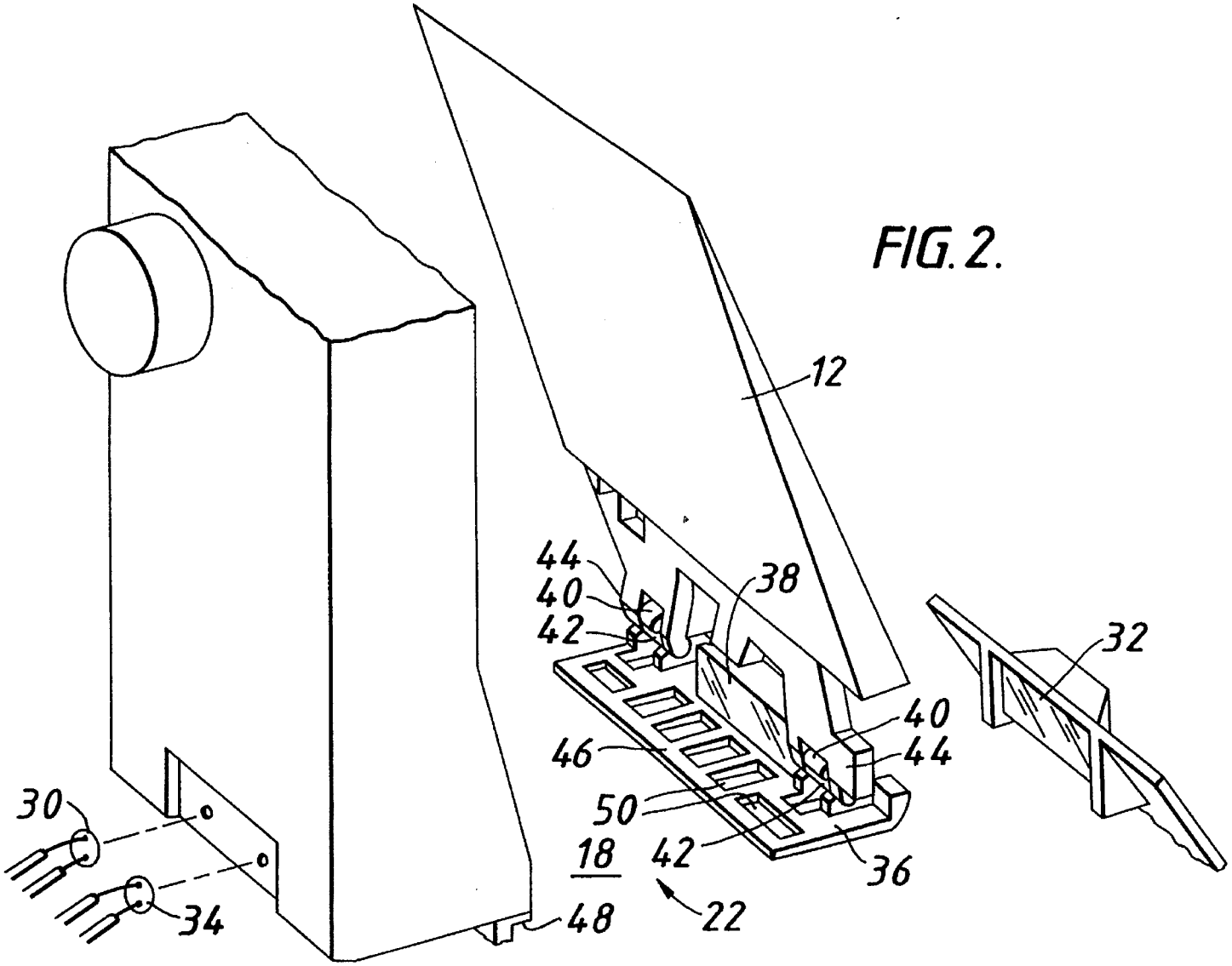
FIG. 2 is a perspective, exploded view of a sensing arrangement in the validator.
Figure 3:
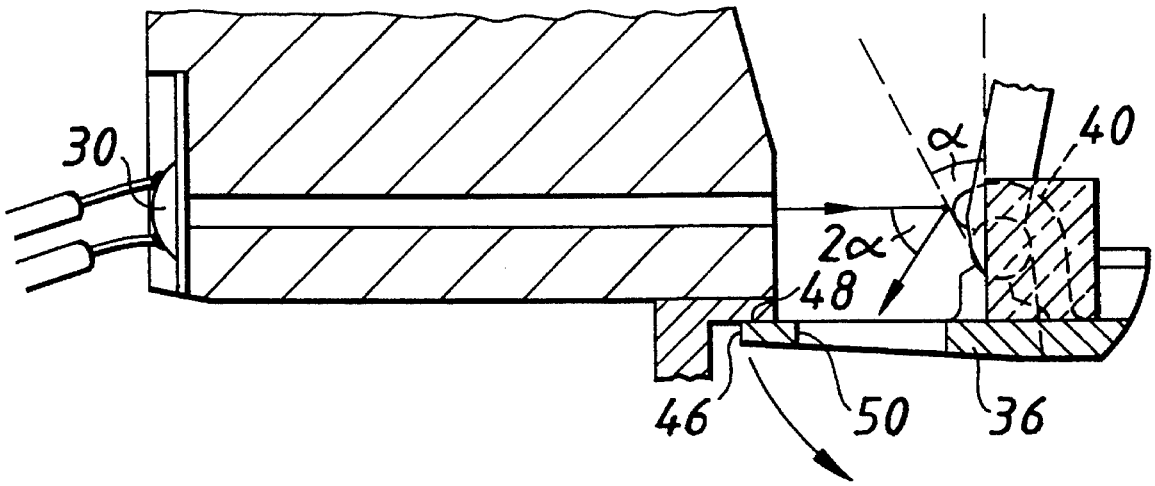
FIG. 3 is a vertical cross section through part of the sensing arrangement.
Figure 4:
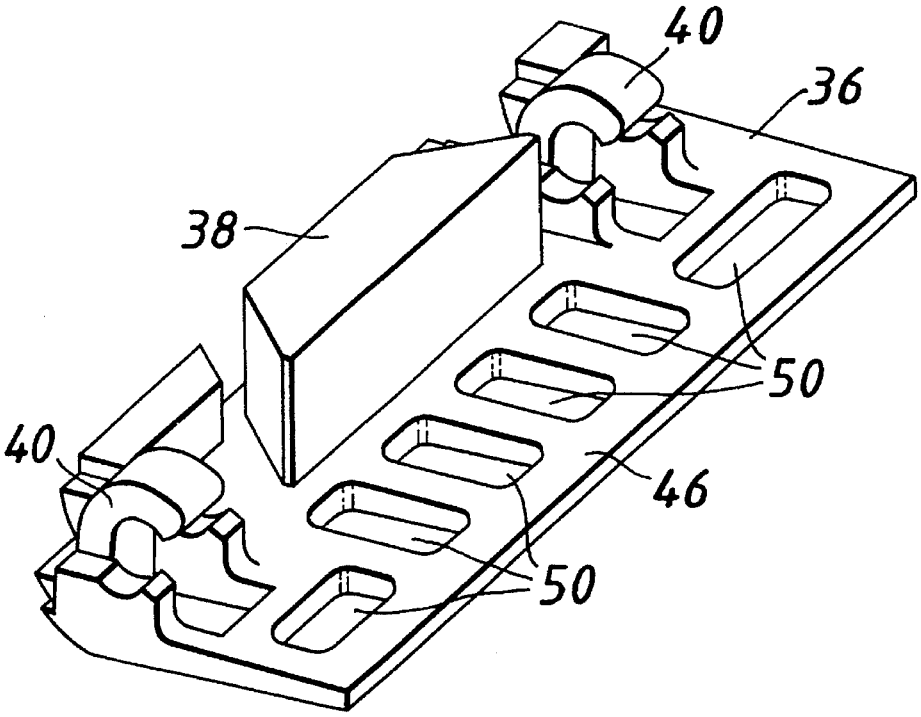
FIG. 4 is a perspective view of a flap of the sensing arrangement.

Referring to FIGS. 2 to 4, the sensing arrangement 22 is generally similar to that disclosed in EP-A-0 017 428, the disclosure of which is incorporated herein by reference. An infra-red light emitting diode 30 emits a beam of infra-red light which traverses the passageway beneath the accept gate 12. A prism 32 is located behind the wall at the opposite side of the passageway, and is arranged so as to reflect the beam first through 90° so that it moves in the direction of the width of the passageway, and then through a further 90° so that it again traverses the passageway and travels towards a photosensor 34 positioned beside the diode 30. The beam thus traverses the passageway at two positions spaced apart in the direction of the width of the passageway.

In the present embodiment, there is provided a flap 36 which carries thereon a further prism 38 mounted in the path of the beam from the diode 30. The prism 38 is substantially identical to the prism 32, and has the same function of reflecting the infrared beam first in the direction of the width of the passageway, and then back to the sensor 34.

The flap 36 has two integrally-formed C-shaped support members 40 which snap-fit on to respective horizontal shafts 42 which are carried by respective pairs of downwardly-depending arms 44. This enables both ready attachment and detachment of the flap 36, and pivoting of the flap about the axes of the shafts 42.

The weight of the prism 38 is such as to pivot the flap 36 in a Clockwise direction in the orientation shown in FIG. 3, so that the flap 36 is maintained normally in a horizontal orientation disposed across the width of the accept path, with its outer edge 46 engaging beneath a ledge 48 on the opposite side of the path from the prism 38. Apertures 50 in the flap 36 render the structure lighter, so, that the weight needed to bias the flap 36 to its normal position is small, and consequently the flap can be pivoted easily away from this position.

When a coin is directed into the accept path 18 by the accept gate 12, it pushes the flap 36 out of the way as it moves past the flap. The flap 36 then moves back to its original position shown in FIG. 3 when the coin has moved past. This is detected by the sensing arrangement 22 because the pivoting of the flap 36 changes the angle of the reflecting surfaces of the prism 38 so that the light reflected back across the passageway is no longer incident on the sensor 34. It will be noted from FIG. 3 that even a small angle $\alpha$ of pivoting caused by the movement of the coin causes a displacement of the reflected beam by $2\alpha$.

As soon as the flap moves back to its original position, the sensor 34 detects the reflected infra-red beam, and this in turn triggers the accumulation of credit in an amount corresponding to the denomination of the coin as determined by the testing sections of the validator.

If, however, the coin is held on a thread, the thread will prevent the flap 36 from moving back to the position shown in FIG. 3, so that no credit is accumulated.

It is not possible to use the thread to pull the coin back up past the flap 36 so as to cause the flap to pivot back and trigger the accumulation of credit. This is prevented firstly by the flap 36 itself, and secondly by the accept gate 12. Also, some arrangements have a directional sensor between the accept gate 12 and the sensing arrangement 22 so that movement in the reverse direction can be sensed and used to prevent the accumulation of credit and/or generate an alarm signal.

Pressing an escrow return or reject button often moves apart the walls of the coin passageway so as to free any jams which may have occurred. It may be therefore that pressing the reject button will permit sufficient room to allow the coin to be pulled back past the flap 36 and gate 12. However, pressing the reject button also often resets the system so that credit cannot be accumulated until a further coin is inserted into the validator. Also, in order to accumulate credit it is preferably necessary for the sensing arrangement 22 to produce an indication that a coin has moved past (as defined in this case by the trailing edge of the signal from the sensing arrangement) within a predetermined time period of a specific event, e.g. within a predetermined time period of passing a sensor disposed in front of the accept gate 12, or within a predetermined time from the leading edge of the signal from the sensing arrangement 22. In such an arrangement, there would be insufficient time for the user to let the coin move past the flap, and then press the reject button and withdraw the coin to cause the accumulation of credit.

As mentioned above, the presence of the thread is sufficient to hold the flap 36 open and thereby prevent credit being awarded. This may depend upon the thread being under tension as a result of the weight of the coin. Alternatively, the thickness of the thread may be sufficient to hold open the flap by the necessary amount. If the device relies upon the tension in the thread, in some arrangements it might be possible that the thread will not go taut until after the coin has passed the sensing arrangement. This will cause the output signal temporarily to switch levels, which may be sufficient to cause credit to be awarded. If desired, the circuitry could be arranged to prevent this by deducting the awarded credit if the sensor arrangement is operated again very quickly after credit has been awarded, or by awarding credit only if the sensing arrangement remains unoperated for a predetermined amount of time after a coin has moved past.

The prism 32 is not required in the present embodiment, and can be omitted. However, it is preferably provided for those situations in which the flap 36 is not desired, and consequently not fitted (e.g. in circumstances in which there is insufficient room for the flap 36).

Figure 5:
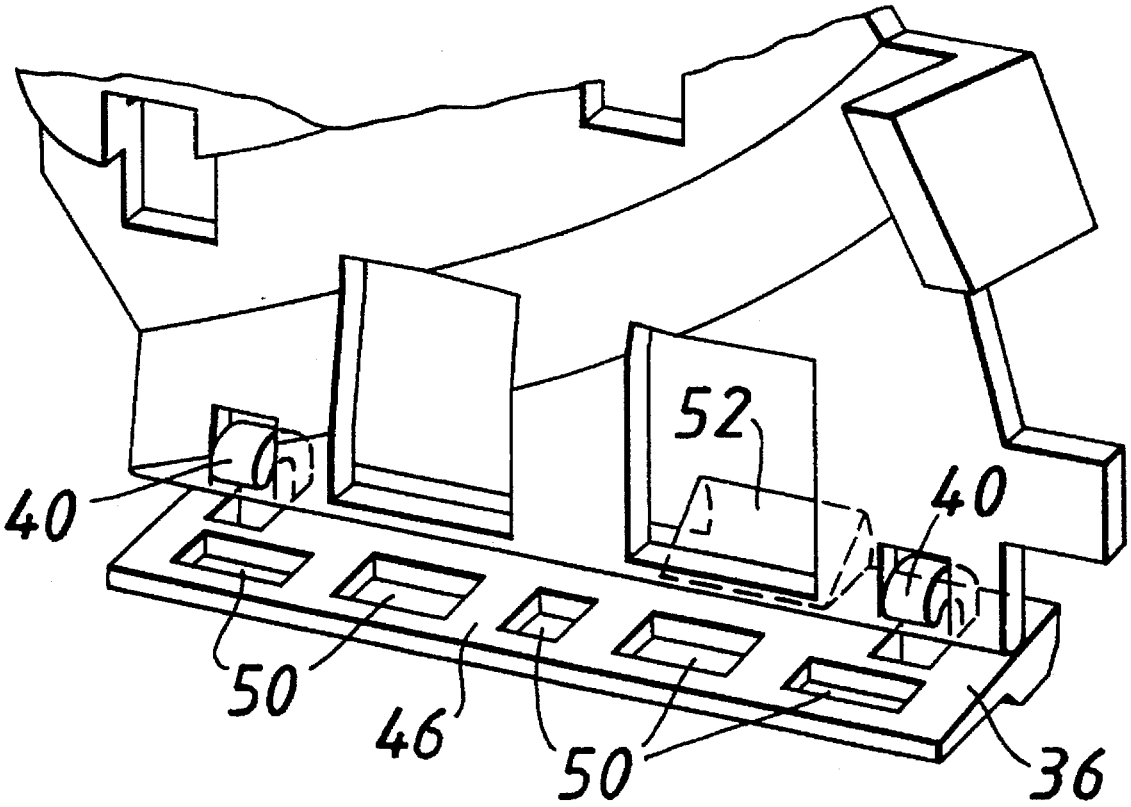
FIG. 5 is a perspective view of part of a sensing arrangement of another embodiment of the invention.

FIG. 5 shows an alternative arrangement which is similar to the embodiment of FIGS. 2 to 4 and in which like reference numbers refer to like elements. The prism 38 is replaced by an integrally-formed wedge-shaped member 52. As the flap 36 is rotated, the member 52 moves into the path of the light beam from the prism 32 to the sensor 34. The arrangement operates in exactly the same way, but in this case a larger amount of movement of the flap 36 is required before the light beam is prevented from reaching the sensor 34.

An additional advantage of the present invention results from the fact that the presence of the string is detected at a position located after the testing section and the accept gate. By the time the coin reaches this position, the location of the string in the direction transverse to the width of the coin passage is easy to predict. It would be more difficult to predict the position near the entry to the validator and therefore the string detector would be less reliable.

In the above arrangements, as the coin moves past the sensing arrangement, the sensor is first prevented from and then allowed to receive light. This arrangement can be reversed so that the sensor normally detects no light, but the passage of the coin causes the flap to move out of the light path or to reflect light to the sensor, and the accumulation of credit occurs when the sensor again receives no light.

Although the above embodiments use the preferred arrangement-whereby the light beam traverses the passageway in two spaced-apart locations, this is not essential. There may be a single light beam crossing the passageway at only one location. Alternatively, some other form of sensor than optical may be used, e.g. an inductive sensor responsive to part of the flap coming into proximity or moving out of proximity as the flap is pivoted away from its normal position.

We claim:

1. A coin validator having an accept gate and a sensing arrangement which is arranged to detect the passage of a coin which has left a testing section and passed the accept gate so as to trigger the accumulation of credit, wherein the sensing arrangement comprises a flap downstream of the accept gate which is moved away from a first position by a coin moving past the sensing arrangement, and which would be held away from the first position by a thread attached to the coin and held by a user, thereby to inhibit the triggering of accumulation of credit.

2. A validator as claimed in claim 1, wherein the sensing arrangement comprises an optical sensor, and the flap is arranged to move between first and second positions, in one of which it interrupts a path of light to the sensor and in the other of which it allows the light to reach the sensor.

3. A validator as claimed in claim 1, wherein the sensing arrangement comprises an optical sensor, and the flap includes means for reflecting light, the flap being moveable between first and second positions, in one of which the light is reflected to the sensor, and in the other of which the light is reflected away from the sensor.

4. A validator as claimed in claim 1, wherein the flap is biased by gravity to a position in which it extends across the width of a coin passageway.

5. A validator as claimed in claim 1, wherein the flap is mounted for pivotal movement.

6. A validator as claimed in claim 1, wherein the flap is detachably mounted.

7. A validator as claimed in claim 6, wherein the sensing arrangement would be capable in the absence of the flap of detecting the passage of a coin.

8. A validator as claimed in claim 1, wherein the validator is arranged to award credit only if the sensing arrangement indicates that a coin has moved past within a predetermined period of that coin having been initially sensed by the sensing arrangement.

9. A validator as claimed in claim 1, wherein the validator is arranged to award credit only if the sensing arrangement indicates that a coin has moved past within a predetermined period of that coin having been sensed at a position in front of the accept gate.

10. A coin validator comprising:

an optical sensor proximate a coin path, downstream of a testing station; and a flap extending across the coin path, the flap comprising means for reflecting light and having a first position obstructing the coin path and a second position not obstructing the coin path, such that in the first position light is reflected from the means for reflecting to the sensor and in the second position light is not reflected from the means for reflecting to the sensor, the flap being adapted to be moved from the first position to the second position by a coin moving along the coin path and the flap further being adapted to return to the first position from the second position after the passage of the coin, the flap capable of being prevented from returning to its first position by a thread attached to the coin and held by a user, wherein credit is not accumulated if the flap does not return to its first position.

11. A coin validator comprising:

a coin path;

a testing station;

a sensor positioned with respect to the testing station and the coin path such that an inserted coin first passes the testing station and then passes the sensor as the coin moves along the coin path;

a flap extending across the coin path, the flap having a first position obstructing a coin path and a second position not obstructing the coin path, the flap being moved from the first to the second position by a coin moving along the coin path and the flap normally returning to its first position after the passage of the coin, the flap being adapted to be prevented from returning to its first position after the coin passes the flap, if a string is attached to the coin and held by a user;

wherein the sensor detects whether the flap has returned to its first position after being moved to its second position by a passing coin, triggering the accumulation of credit unless the flap has not returned to its first position.

12. A coin validator comprising:

a testing station;

a flap arranged downstream of the testing station and arranged to be moved away from a first position by a coin moving therepast and which would normally return to its first position thereafter;

a sensing arrangement responsive to the flap returning to its first position for enabling the accumulation of credit;

the flap being arranged to be held away from the first position by a thread attached to the coin and held by a user, thereby to inhibit the accumulation of credit.

13. A method of operating a coin validator comprising:

testing the acceptability of a coin;

allowing an acceptable coin to pass an accept gate;

sensing the presence of a string attached to the coin and held by a user after the coin has passed the accept gate;

triggering the accumulation of credit if no string is sensed; and inhibiting the accumulation of credit if a string is sensed.

14. The method of claim 13, further comprising:

moving a flap which has a first position obstructing the coin path and a second position not obstructing the coin path, from its first to its second position, by the passage of the coin.

15. The method of claim 14, wherein a string attached to the coin and held by a user prevents the flap from returning to its first position.

16. The method of claim 15, wherein the presence of a string is sensed by determining whether the flap returns to its first position.

17. The method of claim 16, wherein the accumulation of credit is inhibited if the flap does not return to its first position.

18. The method of claim 17, further comprising inhibiting the accumulation of credit if the flap does not return to its first position within a predetermined period of time.

* * * * *

UNITED STATES PATENT AND TRADEMARK OFFICE

CERTIFICATEOF CORRECTION

PATENT NO. : 5,485,906

DATED : January 23, 1996

INVENTOR(S) : Newton

It is certified that error appears in the above-identified patent and that said Letters Patent is hereby corrected as shown below:

Col. 2, line 65, delete "Clockwise" and insert --clockwise--.

Col. 3, line 3, delete "," following "so".

Col. 4, line 35, delete "-" after "arrangement".

In the Claims:

Claim 1, col. 4, line 44, delete "having" and insert --comprising--.

Signed and Sealed this

Twenty-first Day of May, 1996

Bruce Lehman

*Attest:*

BRUCE LEHMAN

*Attesting Officer*

*Commissioner of Patents and Trademarks*